US007157654B2

(12) United States Patent
Trisner et al.

(10) Patent No.: US 7,157,654 B2
(45) Date of Patent: Jan. 2, 2007

(54) PRESSURE SWITCH WITH PROTECTION OF THE MEMBRANE AGAINST OVER-STRETCHING

(75) Inventors: Markus Trisner, Stockach (DE); Joachim Korherr, Orsingen-Nenzingen (DE)

(73) Assignee: TRW Automotive Electronics and Components GmbH & Co., KG, Radolfzell (DE)

( * ) Notice: Subject to any disclaimer, the term of this patent is extended or adjusted under 35 U.S.C. 154(b) by 0 days.

(21) Appl. No.: 11/238,546

(22) Filed: Sep. 29, 2005

(65) Prior Publication Data

US 2006/0065513 A1 Mar. 30, 2006

(30) Foreign Application Priority Data

Sep. 29, 2004 (DE) ..... 10 2004 047 239

(51) Int. Cl.
*H01H 35/36* (2006.01)
*H01H 3/14* (2006.01)

(52) U.S. Cl. ..... 200/285; 200/83 R

(58) Field of Classification Search ..... 200/81 R, 200/82 R, 83 R, 83 B, 83 J, 83 S, 83 N, 200/83 W See application file for complete search history.

(56) References Cited

U.S. PATENT DOCUMENTS 3,335,242 A * 8/1967 Johnson ..... 200/83 P
4,145,588 A * 3/1979 Orcutt ..... 200/83 P
5,296,659 A * 3/1994 Potts et al. ..... 200/83 J
6,255,609 B1 7/2001 Samuelson et al.
6,410,870 B1 * 6/2002 Nishizaki et al. ..... 200/83 R

FOREIGN PATENT DOCUMENTS

| | | |
|---|---|---|
| DE | 5975 | 6/1944 |
| DE | 1490817 | 12/1970 |
| DE | 2750419 | 2/1981 |
| DE | 3541298 | 2/1987 |
| DE | 2842620 | 6/1989 |
| DE | 3935298 | 4/1991 |

* cited by examiner

*Primary Examiner*—Richard K. Lee
(74) *Attorney, Agent, or Firm*—Tarolli, Sundheim, Covell & Tummino LLP

(57) ABSTRACT

A pressure switch for pressures up to a maximum permissible pressure ($p_{max}$), with a housing (1) and a membrane (2), whereby the membrane is fastened in the housing. The membrane has an exposed face on which a pressure can act, and it is deformed when a pressure acts upon it. The pressure switch comprises a means (4) that converts the membrane deformation into a stroke, as well as an electric contact system that interacts with this means. The means causes a membrane deformation to actuate the electric contact system. The pressure switch also comprises a cast solid abutment member (5) that completely fills a cavity between an inner wall of the housing and the face of the membrane opposite the exposed face when the membrane is exposed to the maximum permissible pressure $p_{max}$.

9 Claims, 3 Drawing Sheets

(STATE OF THE ART)

(STATE OF THE ART)

(STATE OF THE ART)

PRESSURE SWITCH WITH PROTECTION OF THE MEMBRANE AGAINST OVER-STRETCHING

Figure 1:
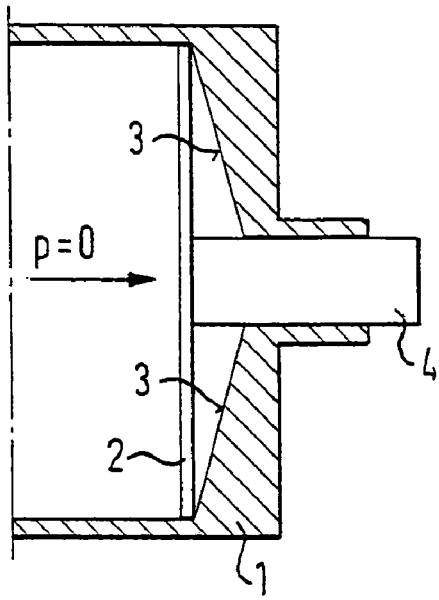

The present invention relates to the field of pressure switches for pressures up to a maximum permissible pressure.

In prior-art pressure switches, a pressure acts on a membrane. Due to this pressure, the membrane undergoes a deformation, as a result of which it is stretched. This deformation translates into a stroke that can be transmitted, for example, by means of a plunger, to an electric contact system. The deformation of the membrane under pressure has to be limited by a stop since otherwise, the membrane could be over-stretched in case of excessive pressure. Normally, a mechanical stop prevents this over-stretching. In particular with membranes made of metal, which can only be stretched to a slight extent, such a stop has to be extremely precise. Conventionally, these stops are made by metal-cutting or pressing working procedures. Consequently, they are always subject to manufacturing tolerances, which means that either the maximum permissible stroke of the membrane is not fully utilized or else it is exceeded. If the maximum permissible stroke is exceeded, the membrane can be damaged.

A pressure switch is to be created with a mechanical stop for the membrane against which the entire surface of the membrane lies when it is exposed to the maximum permissible pressure.

Furthermore, a method is to be proposed for the production of a pressure switch that has a mechanical stop for the membrane against which the entire surface of the membrane lies when it is exposed to the maximum permissible pressure.

The pressure switch according to the invention for pressures up to a maximum permissible pressure $p_{max}$ has a housing and a membrane, the membrane being fastened in the housing. The membrane has an exposed face on which a pressure can act and it is deformed when a pressure acts upon it. Here, the membrane is fastened in the housing in such a way that the deformation of the membrane causes it to be bulged. The pressure switch also comprises a means that converts the membrane deformation into a stroke as well as an electric contact system that interacts with this means. The means causes a membrane deformation to actuate the electric contact system. The pressure switch also comprises a cast solid abutment member that completely fills a cavity between an inner wall of the housing and the side of the membrane facing away from the pressure when the membrane is exposed to the maximum permissible pressure $p_{max}$.

The invention also provides a method for the production of a pressure switch for pressures up to a maximum permissible pressure $p_{max}$. The method comprises the following steps: fastening a membrane in a housing, whereby the membrane has one side on which a pressure p can act; exposing the membrane to the maximum permissible pressure $p_{max}$, as a result of which the membrane is deformed; filling a cavity that is formed between an inner wall of the housing and one side of the membrane facing away from the pressure with a liquid casting compound while the maximum permissible pressure $p_{max}$ is maintained.

The hardening of the casting compound into a solid state then forms the cast abutment member, which completely fills the cavity. Examples of suitable casting compounds are polyurethane resins or epoxy resins. The hardening can be accelerated by the application of heat (e.g. inductively).

Another possibility to accelerate the hardening is through exposure to light. The manufacturing tolerances that are inevitable with metal-cutting or pressing working procedures are thus eliminated. The stop is always fitted individually to the membrane and can thus also compensate for manufacturing tolerances of the membrane. During the exposure to the maximum permissible pressure $p_{max}$, the entire surface of the membrane lies against the stop. As a result, local over-stretching cannot occur.

Preferably, the means for transmitting the membrane deformation is a plunger that is guided by the housing.

In another preferred embodiment, the abutment member is made of a hardened casting compound.

Figure 2:
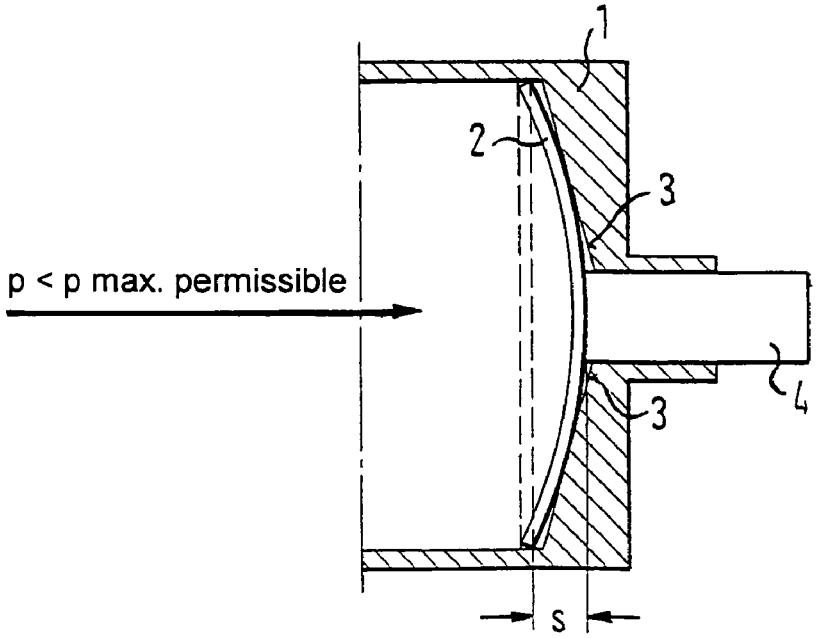
Figure 3:
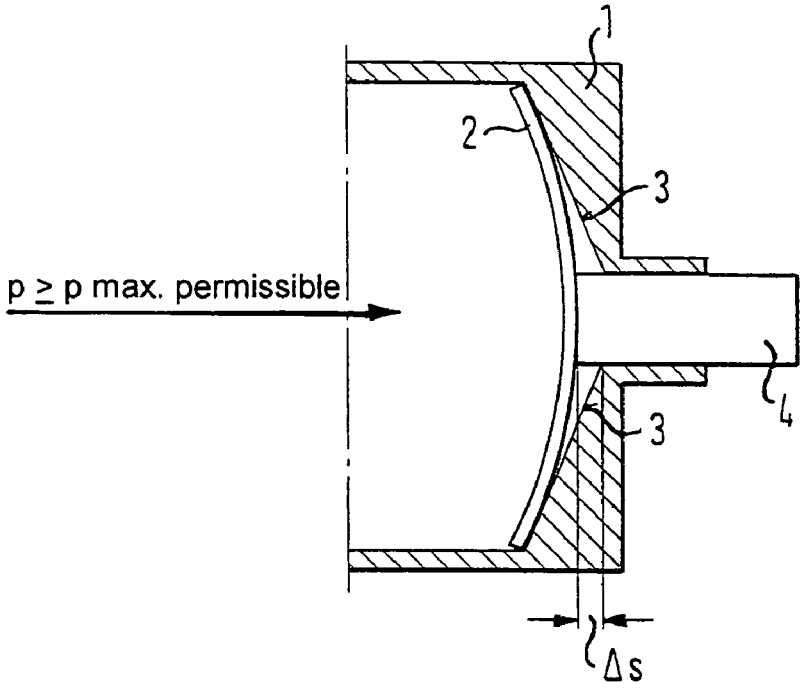
Figure 4:
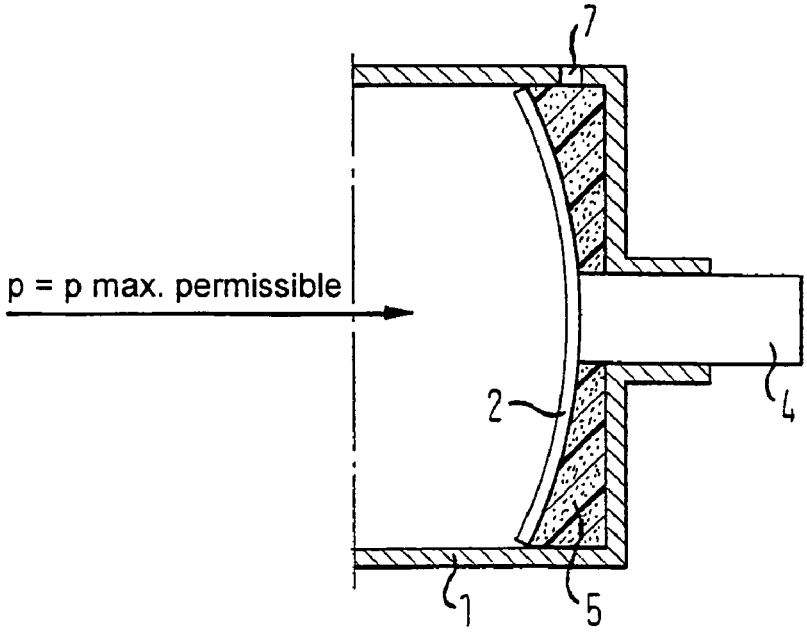
Figure 5:
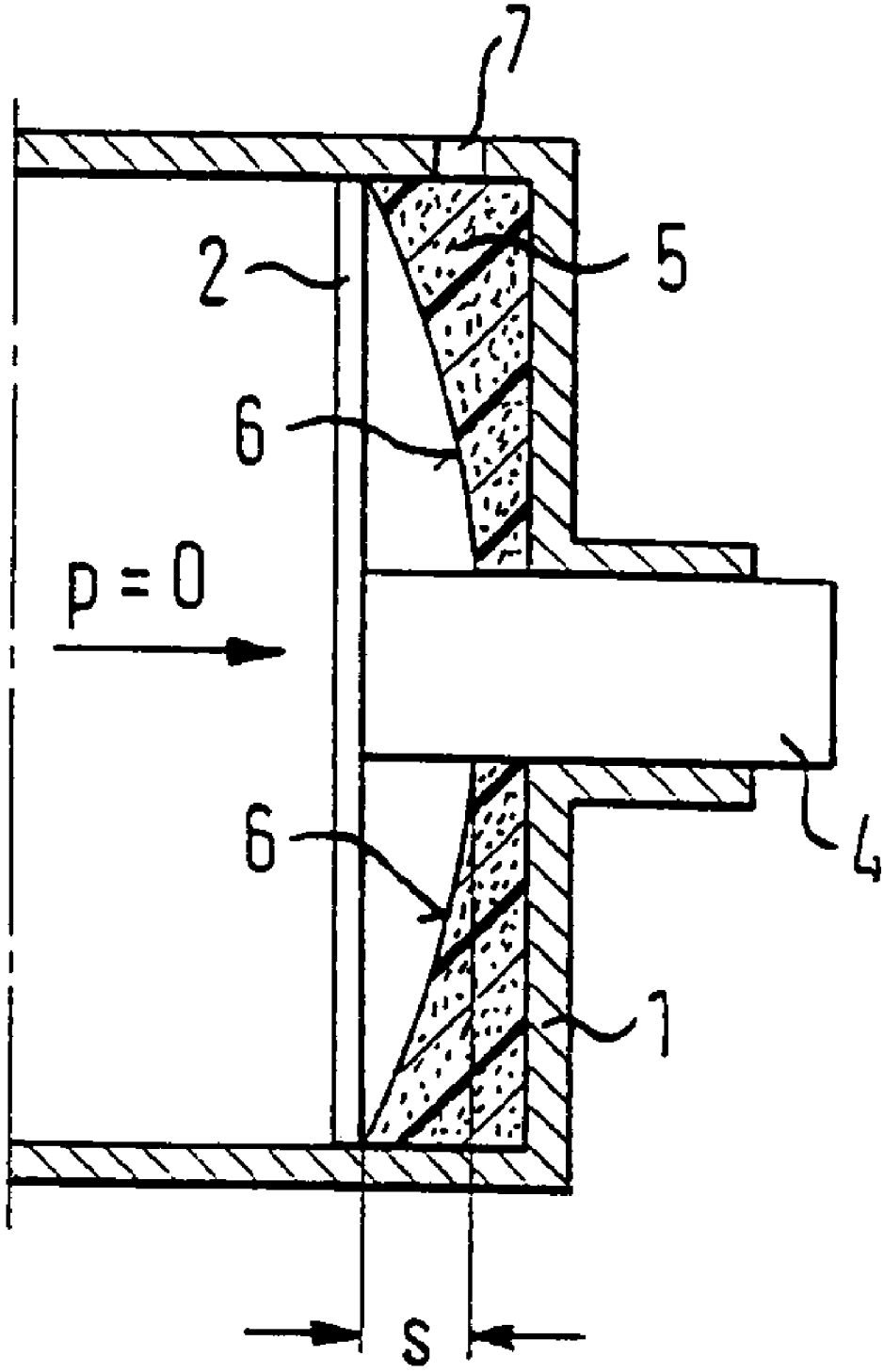

Advantages and special features of the invention can be taken from the explanations below which make reference to the drawings. The drawings show:

FIG. 1 a sectional view of a pressure switch according to the state of the art with a membrane in the non-stretched state;

FIG. 2 a sectional view of a pressure switch according to the state of the art with a membrane that is exposed to a pressure that is lower than the maximum permissible pressure;

FIG. 3 a sectional view of a pressure switch according to the state of the art, whereby the membrane is exposed to a pressure that is greater than the maximum permissible pressure;

FIG. 4 a sectional view of a pressure switch according to the invention, in which the membrane is exposed to the maximum permissible pressure $p_{max}$; and FIG. 5 a sectional view through a pressure switch according to the invention, in which the membrane is unstressed.

In a sectional view, FIG. 1 shows a section of the essential parts of a pressure switch made by a conventional technique. A membrane 2 is fastened in a housing 1 and shown in a state in which no pressure is acting on the membrane. The inner wall of the housing is worked in such a way as to form stop surfaces 3 that are meant to prevent an over-stretching of the membrane 2. A plunger 4 serves to convert the membrane deformation into a stroke that is transmitted to an electric contact system (not shown here).

FIG. 2 shows the same pressure switch when it is exposed to a pressure p that is lower than the maximum permissible pressure $p_{max}$. Due to the manufacturing tolerances during the production of the stop surfaces 3, the membrane 2 is already lying against the stop in some areas, although the maximum permissible pressure $p_{max}$ has not yet been reached. The position of the membrane 2 in the pressure-free state is shown with a broken line. The plunger 4 is deflected by a stroke s.

The sectional view of FIG. 3 shows such a pressure switch in which, due to the manufacturing tolerances, the membrane 2 is not yet or at least not entirely touching the stop surfaces 3, although the pressure p has already reached the maximum permissible pressure $p_{max}$ or even exceeded it. The maximum possible stroke s falls short by a distance $\Delta s$. Hence, the possible stroke is not fully utilized. The membrane can be over-stretched.

In order to solve the problems associated with the manufacturing tolerances, the pressure switch according to the invention follows a different approach for the production of a stop or abutment.

FIG. 4 shows a section of a pressure switch according to the invention during the production process. A housing 1 has a uniform wall thickness and no stop surface has been worked there. The circumferential edge of a membrane 2 is clamped on the housing 1 and is exposed to a maximum permissible pressure $p_{max}$. The membrane 2 is thus in the maximum permissible stretched state. A plunger 4 is deflected by the maximum stroke s. A cavity is formed between the inner wall of the housing and the membrane. This cavity is now filled via an opening 7 of the housing 1 with a liquid casting compound in order to cast an abutment member 5 having an optimally defined stop surface 6 (FIG. 5). Subsequently the casting compound is hardened and gets solid. This procedure can be accelerated by the application of inductive heat. Depending on the material used, an acceleration through exposure to light is also possible. After the casting compound has hardened, the pressure $p_{max}$ can be removed.

FIG. 5 shows the pressure switch according to the invention after the casting compound has hardened. The membrane 2 is in the unstressed state, and no pressure is being exerted on the pressure switch. The plunger 4 is not deflected. The hardened casting compound, for example, a polyurethane resin or an epoxy resin, forms an abutment member 5 that completely fills the cavity shown in FIG. 4. The abutment member 5 has a stop surface 6 against which the entire surface of the membrane 2 lies when it is exposed to the maximum permissible pressure $p_{max}$. The abutment member 5 ensures that the membrane 2 is not over-stretched but that the maximum possible stroke s is fully utilized.

The invention claimed is:

1. A pressure switch for pressures up to a maximum permissible pressure $p_{max}$, comprising the following:

a housing;

a membrane that is fastened in the housing and that has an exposed face on which a pressure p can act, whereby the membrane is deformed when the pressure p acts upon said membrane;

a means that converts the membrane deformation into a stroke; and a solid cast abutment member that completely fills a cavity defined between an inner wall of the housing, the face of the membrane opposite the exposed face, and said means in a condition when the membrane is exposed to the maximum permissible pressure $p_{max}$ so as to form a stop surface against which the entire face of the membrane opposite the exposed face lies when the membrane is exposed to the maximum permissible pressure.

2. The pressure switch according to claim 1, wherein the means for transmitting the membrane deformation is a plunger that is guided by the housing.

3. The pressure switch according to claim 2 wherein said plunger extends through said housing.

4. The pressure switch according to claim 1, wherein the membrane is made of metal.

5. The pressure switch according to claim 1, wherein the cast abutment member is made of hardened casting compound.

6. The pressure switch according to claim 5, wherein the casting compound is a polyurethane resin or an epoxy resin.

7. The pressure switch according to claim 1, wherein the housing includes an opening, said opening being configured to received liquid casting compound for filling the cavity and forming said solid cast abutment member in the cavity.

8. A method for the production of a pressure switch for pressures up to a maximum permissible pressure ($p_{max}$), comprising the following steps;

fastening a membrane in a housing, the membrane having an exposed face on which a pressure p can act;

exposing the membrane to the maximum permissible pressure $p_{max}$, as a result of which the membrane is deformed;

filling a cavity that is formed between an inner wall of the housing, a face of the membrane opposite the exposed face, and a means that converts the membrane deformation into a stroke with a liquid casting compound while the maximum permissible pressure $p_{max}$ is maintained such that a stop surface is formed for receiving the entire face of the membrane opposite the exposed face when the membrane is exposed to the maximum permissible pressure; and hardening of the casting compound into a solid condition.

9. The method according to claim 8 including providing an opening in the housing and filling the cavity via the opening with the liquid casting compound.

* * * * *